US005492110A

United States Patent [19]

Lenz et al.

[11] Patent Number: 5,492,110

[45] Date of Patent: Feb. 20, 1996

[54] SWITCHED ALERT CIRCUIT FOR FIREMAN'S BREATHING SYSTEM

[75] Inventors: Vernon C. Lenz, Union Gap, Wash.; William Siska, Jr., Elma, N.Y.

[73] Assignee: Golden West Communications, Union Gap, Wash.

[21] Appl. No.: 363,393

[22] Filed: Dec. 23, 1994

[51] Int. Cl.[6] ..... A62B 7/02; G08B 3/00

[52] U.S. Cl. ..... 128/202.22; 128/202.27; 128/205.22; 128/204.23; 116/67 R

[58] Field of Search ..... 128/201.22, 201.23, 128/201.24, 201.25, 201.29, 202.11, 202.22, 202.27, 203.29, 204.18, 204.21, 204.23, 204.26, 205.12, 205.22, 206.21, 206.23, 206.24, 206.28, 207.11; 434/226; 116/67 R; 224/101, 153; 109/38, 43, 44; 24/602, 603, 633

[56] References Cited

U.S. PATENT DOCUMENTS

| | | | |
|---|---|---|---|
| 3,112,447 | 11/1963 | Davis | 455/99 |
| 3,400,712 | 9/1968 | Finan | 128/204.23 |
| 3,493,703 | 2/1970 | Finan | 200/502 |
| 3,595,228 | 7/1971 | Simon | 128/202.22 |
| 3,613,677 | 10/1971 | Blasko | 128/204.21 |
| 4,236,463 | 12/1980 | Westcott | 109/33 |
| 4,413,384 | 11/1983 | Lassche | 24/603 |
| 4,418,337 | 11/1983 | Bader | 340/571 |
| 4,453,052 | 6/1984 | Semian | 200/85 R |
| 4,468,656 | 8/1984 | Clifford | 340/539 |
| 4,553,625 | 11/1985 | Tsuge et al. | 24/603 X |
| 4,589,172 | 5/1986 | Hoenigs et al. | 24/602 |
| 4,739,913 | 4/1988 | Moore | 224/215 |
| 4,744,356 | 5/1988 | Greenwood | 128/204.26 |
| 4,799,476 | 1/1989 | McGrady | 128/202.11 |
| 4,850,031 | 7/1989 | Allsop | 455/49.1 |
| 4,875,477 | 10/1989 | Waschke et al. | 128/206.21 |
| 4,899,133 | 2/1990 | Bartlett | 340/573 |
| 4,906,972 | 3/1990 | Spencer | 340/539 |
| 5,045,839 | 9/1991 | Ellis | 340/539 |
| 5,223,818 | 6/1993 | Polo | 340/574 |
| 5,320,092 | 6/1994 | Ryder | 128/202.22 |

*Primary Examiner*—Edgar S. Burr
*Assistant Examiner*—Eric P. Raciti
*Attorney, Agent, or Firm*—Freilich Hornbaker Rosen

[57] ABSTRACT

Safety equipment is described for use by firemen which includes an air tank (42, FIG. 2), a harness (14), a face mask (16), and a PASS (personal alert safety system 20), which assures that the PASS will be activated whenever the equipment is worn. The equipment includes a switch system with at least one switch (31–35) mounted on the equipment at a position to receive force as the equipment is mounted on the fireman, to set or actuate the PASS. The switch (31–34) can sense the force of the equipment against the fireman's body, and/or the switch (35) can sense buckling of a harness belt (48).

9 Claims, 2 Drawing Sheets

SWITCHED ALERT CIRCUIT FOR FIREMAN' S BREATHING SYSTEM

BACKGROUND OF THE INVENTION

SCBA (self contained breathing apparatus) is worn by hazardous environment workers such as firemen and industrial safety personal when entering an area that may contain poisonous gas, smoke or other environment which requires the use of a SCBA. Such equipment usually includes a PASS (personal alert safety system, with requirements defined by National Fire Protection Association NFPA 1982 with revisions in 1988 and 1994). The PASS activates an alarm if the worker stops moving for a predetermined period of time. The alarm is a noise generator on the PASS and/or a device that transmits radio waves to a nearby receiver, to alert others that the worker may be in trouble. It is common for a PASS to generate a moderately loud chirping sound after a specified time, that is usually twenty seconds plus five or minus three seconds, if the worker does not move, and to generate the full alarm after thirty seconds plus or minus five seconds if the worker still has not moved.

Previous PASS circuits had manual switches to turn them on and off, or set and reset, and the worker was supposed to turn on the PASS whenever he put on the equipment. However, many workers did not operate the on switch. One reason is that some workers forgot to operate the switch when they first put on the equipment, and some workers thought they would operate the switch when they put on their face mask just before entering the hazardous environment, but forgot to do so. A low cost system which automatically turned on or set the PASS whenever a worker wore the equipment, would increase safety for hazardous environment workers.

SUMMARY OF THE INVENTION

In accordance with one embodiment of the present invention, a switch system is described for use with equipment that is designed to be worn by a hazardous environment worker, which automatically activates a PASS (personal alert safety system) on the equipment when it is worn. The switch system includes at least one switch that is mounted on the equipment at a position to receive a switch-operating force as the equipment is mounted on the worker. The system also includes a circuit that sets the PASS whenever the switch is operated.

The switch can be placed where there is a force between the equipment and the body of the worker when the equipment is worn. Where the equipment includes a harness with shoulder straps and a back mount that supports an air tank, the force of the shoulder straps against the worker's shoulders and/or the force of the lower part of the back mount against the back of the worker can operate the switch. In another example, the force of the face mask against the head of a person can operate a switch. Where the equipment includes a waist band with mateable belt buckle ends, the switch can sense mating of the buckle ends. A circuit of the switch system preferably keeps the PASS set only so long as a given number of wear-sensing switches are activated, so that it sets the PASS whenever the equipment is worn and resets the PASS whenever the equipment is taken off.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
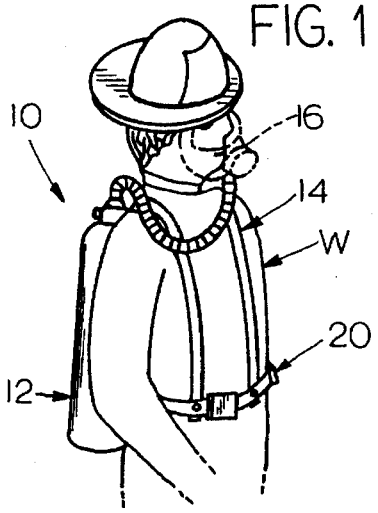
FIG. 1 is an isometric view of equipment shown worn by a hazardous environment worker.

FIG. 1 illustrates equipment 10 which is worn by a hazardous environment worker W such as a fireman. The equipment includes an air tank 12, a harness 14 which holds the air tank at the workers back, and a face mask 16 which is held to the face of the worker. A PASS (personal alert safety system) 20 is held on the worker, as by mounting it on the harness. The PASS senses an emergency situation such as lack of worker motion for a period of time. The PASS activates an alarm if the worker remains motionless for a predetermined period. It is common that after twenty seconds of detecting no motion, the PASS sounds a chirp to remind the worker that it will activate the full alarm in ten seconds if the worker remains motionless, so the worker can move to avoid a false alarm. The alarm usually includes a device that produces a loud sound, and may also include a radio transmitter that transmits an emergency signal to a command station that may be on a nearby fire truck to alert others that a fireman is in danger.

The PASS has on and off switches 22, 24, which may be referred to as set and reset switches, and which are designed to be manually operated by the worker. The worker is supposed to activate the on switch 22 as soon as he/she mounts the equipment on himself, and he can activate the off switch 24 when he takes off the equipment. However, experience shows that many workers do not operate the on switch 22. Some workers forget to operate the on switch when putting on the equipment, and some workers decide that they will turn on the equipment when they put the face mask on their head just before entering a hazardous environment, but forget to do so. Some workers find the PASS annoying because it chirps if the worker sits down to rest for a while, and neglect the risk of harm that may occur if they forget to turn on the PASS before entering the hazardous environment. A system that assured turn on or setting of the PASS whenever the equipment was worn, and which automatically turned off or reset the equipment when it was not worn, would increase safety for hazardous environment workers.

Figure 2:
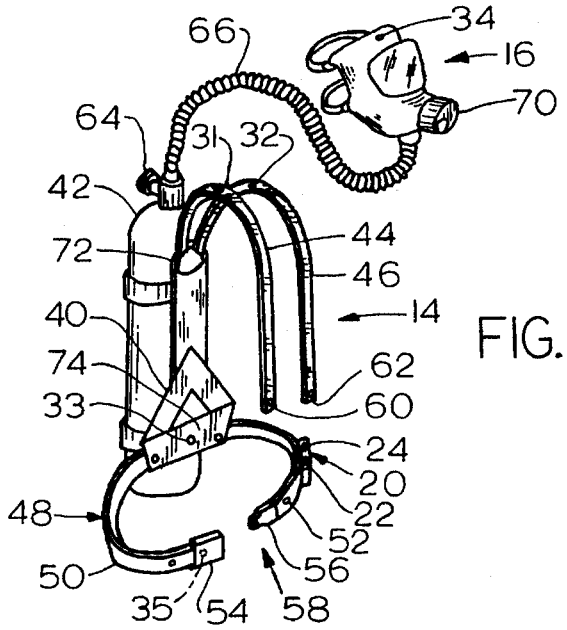
FIG. 2 is an isometric view of just the equipment of FIG. 1.

As shown in FIG. 2, the harness 14 of the equipment includes a back mount 40 that supports an air tank 42, a pair of shoulder straps 44, 46 that extend from the top of the back mount, and a waist belt 48 attached to a lower portion of the back mount. The belt 48 includes belt strap parts 50, 52 with belt buckle ends 54, 56. A worker is supposed to place the belt around his waist and mate the buckle ends 54, 56, and is supposed to attach lower ends 60, 62 of the shoulder straps to locations on the belt parts 50, 52, using fasteners such as snaps. Prior to putting on the harness, the worker opens an air valve 64 which supplies air through a hose 66 to a valve assembly 70 on the face mask. The valve assembly 70 is a demand type which does not supply air until the worker breathes in. The worker is also supposed to depress the on switch 22 to activate the PASS. It is noted that perhaps five percent of the workers do not mate the buckle ends 54, 56 of the belt buckle 58, which may be due to the belt being too tight around their waists.

Figure 3:
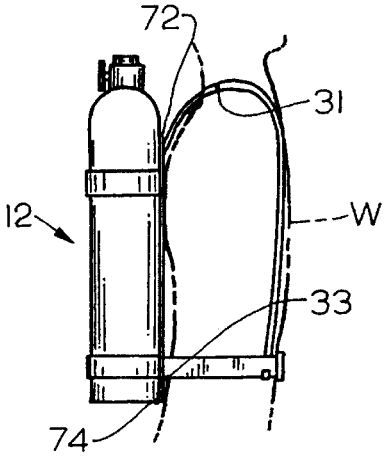
FIG. 3 is a right side elevation view of the equipment and worker of FIG. 1.
Figure 4:
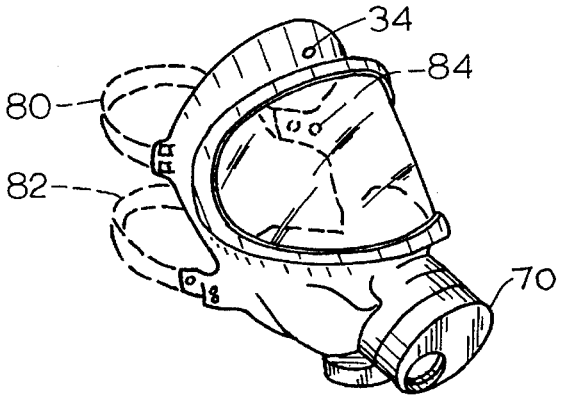
FIG. 4 is an isometric view of the mask of the equipment of FIG. 2.

In accordance with the present invention, one or more switches of a switch system, are provided that sense that the equipment is being worn, to automatically activate the PASS. FIG. 2 shows five of such switches 31–35, including four switches 31–34 that sense the force of the equipment against the body of the worker (e.g. such as against his clothes) and with a fifth switch 35 sensing mating of the belt buckle 58. Switches 31 and 32 are shoulder switches lying on portions of the shoulder straps 44, 46 that apply a considerable portion of the weight of the equipment to the shoulder of the worker. FIG. 3 shows one of those shoulder switches 31. A back switch 33 lies at a lower portion of the back mount 40 and senses the force of the equipment against the back of the wearer. With an upper portion 72 of the back mount being supported by the shoulder straps, the weight of the air tank 42 will cause a lower portion 74 of the back mount to press against the workers back. FIG. 4 shows the location at 34 of the face mask switch, with the switch at 34 pressing against the forehead of the wearer when the face mask is pressed against the wearer by head straps 80, 82. Another location indicated at 84, is a location of the mask that presses against the side of the worker's head due to the force of the straps.

Figure 5:
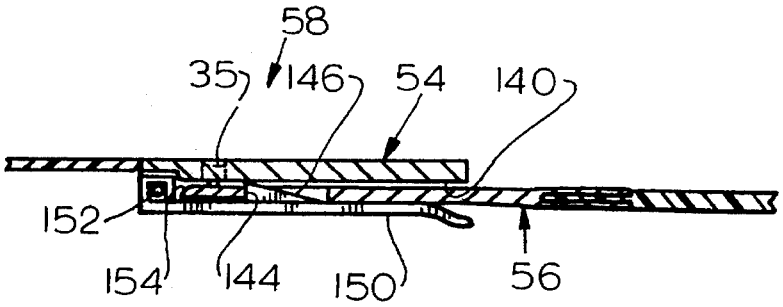
FIG. 5 is a sectional view of the belt buckle of the equipment of FIG. 2.

FIG. 5 shows a switch 35 which senses mating of the belt buckle ends 54, 56. The worker's right belt buckle end 54 has a slot 140 into which the tang-like buckle end 56 is received. The buckle end 56 has an aperture 144. When the buckle end 56 is fully received, a latch 146 lying on a spring-biased lever 150 snaps behind an end wall of the aperture 144 to hold the buckle end 56 in place. The lever 150 is pivotally mounted about a shaft 152 on the rest of the buckle end, and a spring (not shown) tends to keep the lever in the closed position. The switch 35 is of the construction shown at 33 in FIG. 6, with the end 104 of the switch piston 94 being more beveled and being placed so it is depressed by the leading end 154 of the belt end 56. The sensing of mating of belt buckle ends is perhaps more reliable than the sensing of force of equipment locations against the wearer's body, but belt buckle sensing will not work in those cases where the worker does not buckle his belt.

Figure 6:
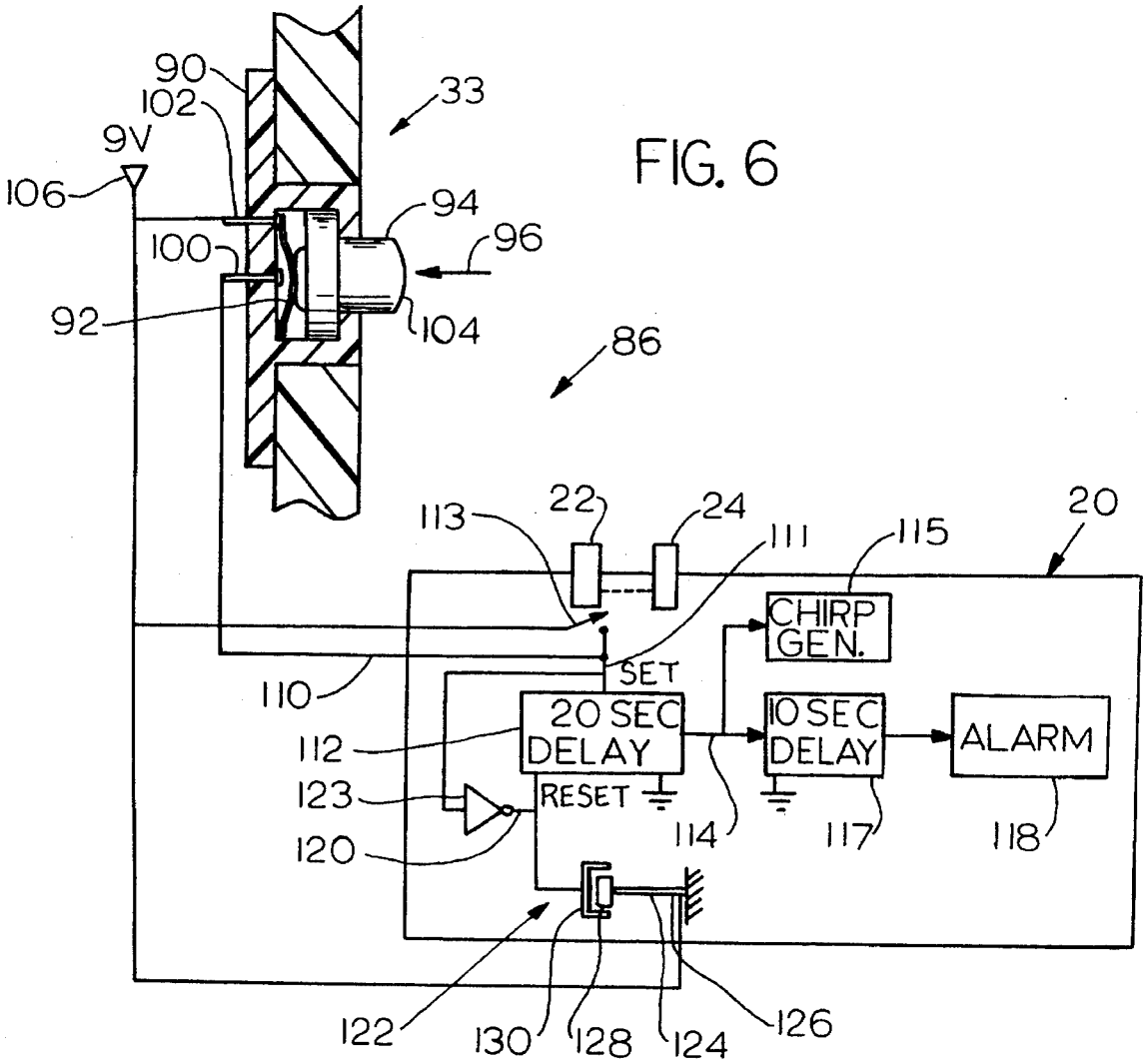
FIG. 6 is a sectional and block diagram view of a switch and the switch system of the equipment of FIG. 2.

FIG. 6 illustrates an example of a switch system 86 which assumes that switch 33 alone will turn on, or set, the PASS 26. The switch 33, which lies at the lower portion of the back mount, includes a switch housing 90, a dome-shaped switch element 92, and a switch actuator in the form of a piston 94. When the piston 94 is depressed in the direction of arrow 96, it depresses the middle of the dome switch element 92 to make it engage a contact 100. The periphery of the dome engages another contact 102. Thus, pressure against an outer face 104 of the switch piston causes closing of the switch. This type of switch is known and may be closed or opened when activated. The piston 94 can include a foam plastic section to enable it to be pressed further. When the switch closes, current from a nine volt current supply 106 passes through the switch to a set input 110 of the PASS 20 to set it. The particular PASS can be set and reset respectively by activating buttons 22, 24 which are mechanically coupled so only one is in an activated state at any time. When the button 22 is depressed, it remains depressed and keeps the PASS continuously set, until the reset button 24 is depressed. An electrical signal on electrical set input 111 sets the PASS only so long as current at nine volts is received on the input 111, either through a switch 113 operated by the set button, or through the switch 33. The area of input 111 acts like an OR gate.

The PASS includes a twenty second delay subcircuit 112 which, when set, counts a period of twenty seconds, and then sends a signal over line 114 to a chirp generator 115. The signal on line 114 causes the chirp generator to generate a chirp sound that tells the worker to move. The signal on line 114 also activates a ten-second delay subcircuit 117 which activates an alarm 118 if current continues to be received on line 114 for more than ten seconds, but which resets itself whenever there is no signal on line 114.

The twenty-second delay subcircuit 112 has a reset input 120 which resets it whenever it receives a current thereat, through an inverter 123 that generates a reset signal whenever there is no set signal at 111. A motion sensor 122 of the PASS includes a beam 124 with one end 126 fixed in position on the equipment and with another end 128 carrying a weight with an electrical contact at its outside. Whenever the worker moves, the beam 124 bends and the weight 128 touches a contact 130 to complete a circuit between the nine volt current source 106 and the reset input 120. Thus, so long as the worker moves during any twenty second period, the delay subcircuit 112 will be repeatedly reset and will not deliver a signal to the subcircuit 117 and to alarm 118 to activate it. The PASS can be initially set to begin the twenty second countdown, either manually by depressing the switch 22, or automatically whenever the switch 31 is closed.

Whenever the worker puts on the equipment, the switch 31 will be depressed and will activate the PASS 20, whether or not the worker depresses the set button 22. Whenever the worker takes off the equipment, he should depress the reset button 24, and if he does not do so, then after twenty seconds the equipment will generate a chirp sound to remind him to do so. The switch 33 will not be closed, or activated, because there is no longer pressure on the switch to close it. Thus, the switch 33 assures that the PASS will be activated whenever the equipment is worn by a hazardous environment worker, even if he forgets to manually activate the PASS, and the switch 33 will automatically cease to set the PASS whenever the equipment is removed from the worker.

A switch similar to the switch 33 shown in FIG. 6 can be used at all of the locations 31–34 at which a force is to be sensed between the equipment and the body (e.g. clothes) of the wearer. A switch similar to 33 also is used as the switch 35 that senses when the belt buckle ends are mated.

Figure 7:
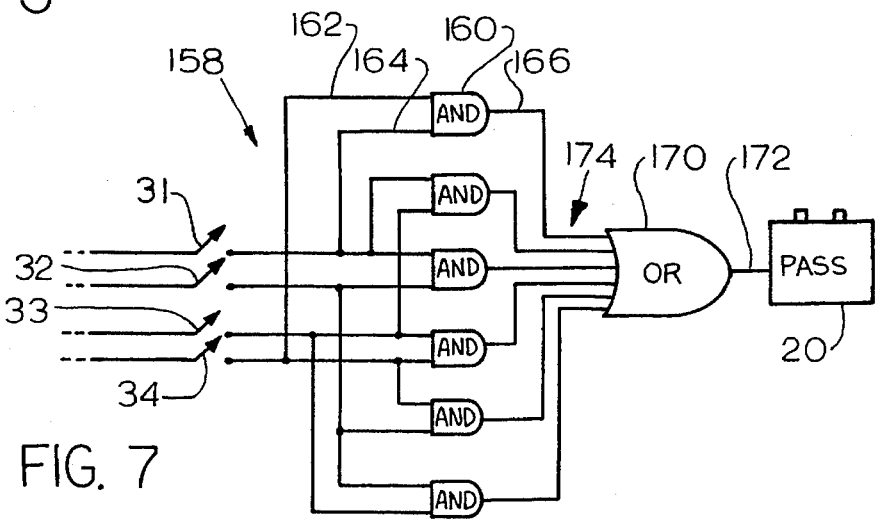
FIG. 7 is a block diagram of a switch system constructed in accordance with another embodiment of the invention.

FIG. 7 shows another switch system 158 which senses the closing of two of four switches 31, 32, 33, and 35, with all but the face mask switch being included. The four switches are connected to six AND gates 160 which each has two inputs 162, 164 and an output 166 that delivers a signal only if there is a signal on both of its inputs 162, 164. The output of the six AND gates is delivered to an OR gate 170. The OR gate 170 delivers a signal on its output 172, whenever a signal is received on any of its six inputs 174. The output 172 of the OR gate is delivered to the PASS 20 which is similar to that shown in FIG. 6 with line 172 corresponding to line 110. The advantage of this circuit is that it avoids a false alarm after the equipment is taken off, in the event that a single switch is malfunctioning so it is always closed, or is pressed against the ground and is thereby closed. However, the fact that activation of at least two of the four switches will set the PASS, results in a very high probability that the PASS will be set whenever the equipment is worn.

Thus, the invention provides equipment designed to be worn by a hazardous environment worker, which assures that the PASS will be activated, or set, whenever the equipment is worn, even if the worker forgets or otherwise neglects to set it, and which resets the PASS when the equipment is taken off (and the manual off switch is depressed, if the on switch was previously depressed). The equipment includes at least one switch which senses wearing of the equipment. The switch can be constructed to sense the force of the equipment against the body of the worker (a part other than his hand), and may include at least one switch that senses the force of a pressure strap against the shoulder of a worker, a switch that senses the force of an air tank back mount against the lower back of the worker, and a switch that senses the force of a face mask against the head of a worker. A switch can be used that senses buckling of a belt. A circuit system can be used which sets the PASS only when a predetermined number of the switches, such as at least two, are activated.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. Equipment designed to be worn by a hazardous environment worker, comprising:

a PASS (personal alert safety system) that must be activated so it can generate an alarm signal in the event of detection of an emergency situation, said PASS including a first device that is constructed to sense an emergency situation that is life-threatening and that generates a first signal only upon such sensing, and a second device that automatically generates said alarm signal when it senses said first signal;

switch means mounted on said equipment for receiving switch-operating force as said equipment is worn and to not receive force when said equipment is not worn;

a circuit which is responsive to operation of said switch means, to activate said PASS to automatically generate said alarm signal only upon sensing of an emergency situation.

2. The equipment described in claim 1 wherein:

said equipment comprises an air tank back pack assembly with a lower location that presses against the lower back of a worker and a harness that includes a waist belt having a pair of waist belt strap parts extending from said back pack and having joinable belt buckle locations to encircle the worker's waist, and a pair of shoulder straps extending from said back pack and having locations designed to be supported on the worker's shoulders and having ends that are joinable to said waist belt;

said switch means comprises a force sensing switch mounted at at least one of said locations with said PASS being activated by operation of said switch to be ready to generate said alarm signal but to not generate said alarm signal until it senses said emergency situation.

3. A breathing system designed to be worn by a hazardous environment worker, which includes an air tank, a harness device for mounting the air tank on the worker, a face mask device which is mountable on the head of the worker and which is connected by a hose to the air tank, and alarm apparatus which senses movement of the worker and which generates an alarm signal if the worker does not move during a predetermined period of time, when the apparatus is set, comprising:

at least one activatable switch mounted on at least one of said devices and coupled to said alarm apparatus to set it;

said switch has a force-sensing part positioned to be activated by a force applied directly from the body of a worker to said force-sensing part of said switch.

4. The system described in claim 3 wherein:

said apparatus includes means for setting said apparatus substantially only while said at least one switch is activated by force applied by a worker's body, and for resetting said apparatus when the equipment is removed from the worker and said switch is no longer activated.

5. The system described in claim 3 wherein:

said apparatus includes a manually operable control with on and off parts that are designed to be manually operated by the worker's fingers to respectively set and reset said apparatus, independently of said at least one switch, so said apparatus is set when either said on part is operated or said at least one switch is activated, and said apparatus is reset only when both said off part is in said off position and said at least one switch is not activated.

6. A method for operating a PASS (personal alert safety system) that is located on breathing equipment, when the breathing equipment is mounted on a hazardous environment worker, comprising:

sensing the mounting of the breathing equipment on a worker, and activating said PASS automatically in response to said step of sensing;

operating said PASS to generate an alarm signal upon sensing of a life-threatening situation for a worker wearing the breathing equipment, only upon sensing the mounting of the breathing equipment on a worker.

7. Equipment designed to be worn by a hazardous environment worker comprising;

a PASS (personal alert safety system) that must be activated so it can generate an alarm signal in the event of detection of an emergency situation;

a plurality of switches each mounted on said equipment at a position to receive switch-operating force as said equipment is mounted on a worker;

a circuit which is responsive to operation of said at least one switch, to activate said PASS;

said equipment comprises an air tank back pack assembly with a lower location that presses against the lower back of the worker and a harness that includes a waist belt having a pair of waist belt strap parts extending from said back pack and having joinable belt buckle locations to encircle the worker's waist, and a pair of shoulder straps extending from said back pack and having locations designed to be supported on the worker's shoulders and having ends that are joinable to said waist belt;

each of said plurality of switches is a force sensing switch and each of said switches is mounted at a different one of said locations;

said circuit is constructed to actuate said PASS only upon the actuation of a plurality of said switches.

8. Equipment designed to be worn by a hazardous environment worker comprising;

a PASS (personal alert safety system) that must be activated so it can generate an alarm signal in the event of detection of an emergency situation;

at least one switch mounted on said equipment;

a circuit which is responsive to operation of said at least one switch, to activate said PASS;

said equipment includes an air tank assembly and a harness, said harness including a pair of waist strap parts having belt buckle ends, and said switch is mounted on a first of said belt buckle ends to be operated when said belt buckle ends are buckled together.

9. A method for operating a PASS (personal alert safety system) that is located on breathing equipment, when the breathing equipment is mounted on a hazardous environment worker, comprising:

sensing the mounting of the breathing equipment on a worker, and activating said PASS automatically in response to said step of sensing;

said equipment includes a tank of compressed breathing gas and a harness which includes shoulder straps and a belt with a belt buckle that includes a pair of mateable buckle ends;

said step of sensing the mounting, includes sensing the mating of said buckle ends.

* * * * *